US006361651B1

(12) United States Patent
Sun

(10) Patent No.: US 6,361,651 B1
(45) Date of Patent: Mar. 26, 2002

(54) CHEMICALLY MODIFIED PULP FIBER

(75) Inventor: Tong Sun, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/447,380

(22) Filed: Nov. 23, 1999

Related U.S. Application Data

(60) Provisional application No. 60/114,273, filed on Dec. 30, 1998.

(51) Int. Cl.[7] ..... D21H 21/20

(52) U.S. Cl. ..... 162/158; 162/146; 162/157.6; 162/164.7; 162/168.3; 162/166; 162/175; 162/182; 162/183; 8/120; 8/108.5; 8/115.7; 8/191

(58) Field of Search ..... 162/146, 157.6, 162/158, 164.7, 168.3, 175, 166, 182, 183; 8/120, 168.5, 115.7, 116.1, 191

(56) References Cited

U.S. PATENT DOCUMENTS

| | | | |
|---|---|---|---|
| 2,926,116 A | | 2/1960 | Keim |
| 2,986,489 A | | 5/1961 | Maxwell |
| 3,096,231 A | | 7/1963 | Griggs et al. |
| 3,099,573 A | | 7/1963 | Borchert |
| 3,103,462 A | | 9/1963 | Griggs et al. |
| 3,116,199 A | | 12/1963 | Cruz, Jr. et al. |
| 3,236,792 A | | 2/1966 | Curtis |
| 3,409,500 A | | 11/1968 | Strazdins et al. |
| 3,448,005 A | | 6/1969 | Allison, Jr. et al. |
| 3,469,569 A | | 9/1969 | Brockbank |
| 3,520,774 A | | 7/1970 | Roth |
| 3,657,066 A | | 4/1972 | Chene et al. |
| 3,658,640 A | | 4/1972 | Coscia et al. |
| 3,686,025 A | | 8/1972 | Morton |
| 3,755,220 A | | 8/1973 | Freimark et al. |
| 3,773,612 A | | 11/1973 | Avis |
| 3,773,736 A | | 11/1973 | Williams et al. |
| 3,907,633 A | | 9/1975 | Suzuki et al. |
| 3,932,210 A | | 1/1976 | Suzuki et al. |
| 3,976,824 A | | 8/1976 | Ariyoshi et al. |
| 3,998,690 A | | 12/1976 | Lyness et al. |
| 4,011,389 A | | 3/1977 | Langdon |
| 4,035,229 A | | 7/1977 | Rave |
| 4,152,199 A | | 5/1979 | Hamerstrand et al. |
| 4,217,425 A | | 8/1980 | Ballweber et al. |
| 4,248,595 A | | 2/1981 | Lask et al. |
| 4,347,100 A | | 8/1982 | Brucato |
| 4,388,439 A | | 6/1983 | Maslanka |
| 4,487,884 A | | 12/1984 | Maslanka |
| 4,515,657 A | | 5/1985 | Maslanka |
| 4,537,657 A | | 8/1985 | Keim |
| 4,557,801 A | | 12/1985 | Avis |
| 4,722,964 A | | 2/1988 | Chan et al. |
| 4,880,498 A | | 11/1989 | Moore et al. |
| 4,908,097 A | | 3/1990 | Box |
| 5,015,245 A | | 5/1991 | Noda |
| 5,200,036 A | | 4/1993 | Noda |
| 5,223,096 A | | 6/1993 | Phan et al. |
| 5,316,623 A | | 5/1994 | Espy |
| 5,318,669 A | | 6/1994 | Dasgupta |
| 5,320,711 A | | 6/1994 | Dauplaise et al. |
| 5,385,754 A | | 1/1995 | Earl et al. |
| 5,502,091 A | | 3/1996 | Dasgupta |
| 5,525,664 A | | 6/1996 | Miller et al. |
| 5,667,637 A | | 9/1997 | Jewell et al. |
| 5,935,383 A | * | 8/1999 | Sun et al. ..... 162/158 |

FOREIGN PATENT DOCUMENTS

| | | |
|---|---|---|
| DE | 1 932 753 A | 1/1970 |
| JP | 05-106190 A | 4/1993 |
| SU | 511405 | 4/1976 |

OTHER PUBLICATIONS

Espy, Herbert H. and Gordon W. Geist, "Recycled Pulp In Wet–Strength Grades Using Neutral/Alkaline–Curing Resins," *TAPPI 1991 Papermakers Conference Proceedings*, TAPPI Press, Atlanta, Apr. 1991, pp. 157–164.

Walecka, Jerrold A., "An Investigation of Low Degree of Substitution Carboxymethylcelluloses," *TAPPI*, vol. 39, No. 7, Jul. 1956, pp. 458–463.

* cited by examiner

*Primary Examiner*—Stanley S. Silverman
*Assistant Examiner*—Mark Halpern
(74) *Attorney, Agent, or Firm*—Gregory E. Croft

(57) ABSTRACT

The wet strength softness absorbency, absorbency rate and other valuable properties in paper products, tissues, wipes, towels, etc. can be improved by using, in the paper forming process, a cellulosic material comprising a carboxymethyl cellulose material associated with a monomeric or polymeric cationic additive material. A process of the invention comprises a fiber surface carboxymethylation and an aqueous medium followed by blending the modified fibers with a cationic additive under varying conditions and wet forming the tissue and towel products. The additive is typically a cationic additive that preferentially associates with a carboxymethyl group on the cellulose surface. The affinity between the positively charged cationic groups in the polymeric or monomeric additive material to the negatively charged carboxyl group in the carboxymethyl cellulose modified fiber improves various attributes of the paper products.

14 Claims, 4 Drawing Sheets

CHEMICALLY MODIFIED PULP FIBER

Provisional Application No. 60/114,273 filed Dec. 30, 1998.

FIELD OF THE INVENTION

The invention relates to chemically modified cellulosic materials that can have improved properties such as wet strength, softness, absorbency, absorbency rate and others. The invention relates to a chemically modified cellulosic product and to a process for improving the cellulosic material.

BACKGROUND OF THE INVENTION

Wet laid cellulosic fibers that are untreated prior to sheet formation typically have substantially unacceptable properties for use in towels, wipes and tissues. Important properties include wet strength, softness, absorbency, absorbency rate, etc. In other words, the wet strength of the material can be such that, upon immersion in water, paper can lose a great deal of its tensile strength in both sheet dimensions, can become a pulpy unstable mass, can have no tissue softness as that term is understood, can have very little absorbency or can have a very low absorbency rate until saturation is reached. Such sheet-like materials have little or no attractiveness to consumers in the market because of a substantial lack of utility in many operations in which the wet strength and absorbency of the tissue paper or wipe is of critical importance.

The use of additives to improve the properties of wet laid sheets is well known. Such additives include sizing agents, dry strength additives, wet strength additives, surface treatments, coatings, and all are well known. Such materials include rosin based sizing materials, cellulose reactive sizing materials, wax emulsions, fluorochemicals and others. Dry strength additives are typically polymeric materials including such compositions as polyacrylamides, vegetable gums, starches and others. Wet strength additives are commonly understood to be urea-formaldehyde resins, melamine-formaldehyde resins, amino-polyamide epichlorohydrin resins, polymeric amine epichlorohydrin resins, aldehyde modified resins and others. Cellulosic web surface treatments typically include pigments, resin coatings and lamination sheets.

One type of wet strength enhanced material is a carboxymethyl cellulose polymer. Such materials are used as add on additives applied directly to a typical cellulosic sheet. Carboxymethyl cellulose is often used with a type one type polymer such as a polyalkylene polyamine or a polyamido amine that can be post reactive with epichlorohydrin to produce a useful additive material. The application of sodium carboxymethyl cellulose with other cationic additives to a cellulosic sheet is one useful wet strength additive strategy that has some measure of success. Such processes are disclosed in Miller et al., U.S. Pat. No. 5,525,664 and Espy, U.S. Pat. No. 5,316,623. Further, Griggs et al., U.S. Pat. No. 3,103,462, teach a partially acylated cellulosic fiber which is followed by the use of a cationic thermosetting resin. Lask et al., U.S. Pat. No. 4,248,595, teach a crosslinked fiber. The cellulose is converted using a carboxyalkylating etherifying agent and then reacted with a crosslinking agent in an aqueous medium. Chene et al., U.S. Pat. No. 3,657,066, teach a wet strength carboxylated cellulosic material. In Chene et al., the underlying cellulosic fiber is oxidized to produce carboxyl groups which are then crosslinked with a melamine formaldehyde resin. These references are primarily directed to crosslinked materials that have covalently bonded crosslinking agents that directly bond one cellulosic fiber moiety to a second cellulosic fiber moiety through substantially increase. the molecular weight of the resulting material. This also is an accepted regimen for improving the properties of the cellulosic materials. While this is a useful process, the cost and properties of the resulting product can be a problem in the marketplace.

For the purpose of this patent application, the term "carboxymethyl cellulose material" indicates a cellulosic fiber that has been modified with a chemical reagent to introduce carboxymethyl cellulose ether groups bonded directly onto a hydroxyl site which introduces a terminal carboxyl group into the cellulosic moiety. For the purpose of this patent application, a cationic additive material, whether small molecule-monomeric or polymeric, is a positively charged nitrogen containing additive material that ionically associates with carboxymethyl cellulose groups in the paper product. The materials disclosed in this application and the products of the processes of the application are not covalently crosslinked into molecular weight cellulosic materials. The association of the carboxymethyl groups ionically with the cationic additive materials enhances the physical properties of the materials without covalent bonding.

DETAILED DESCRIPTION OF THE INVENTION

Figure 1:
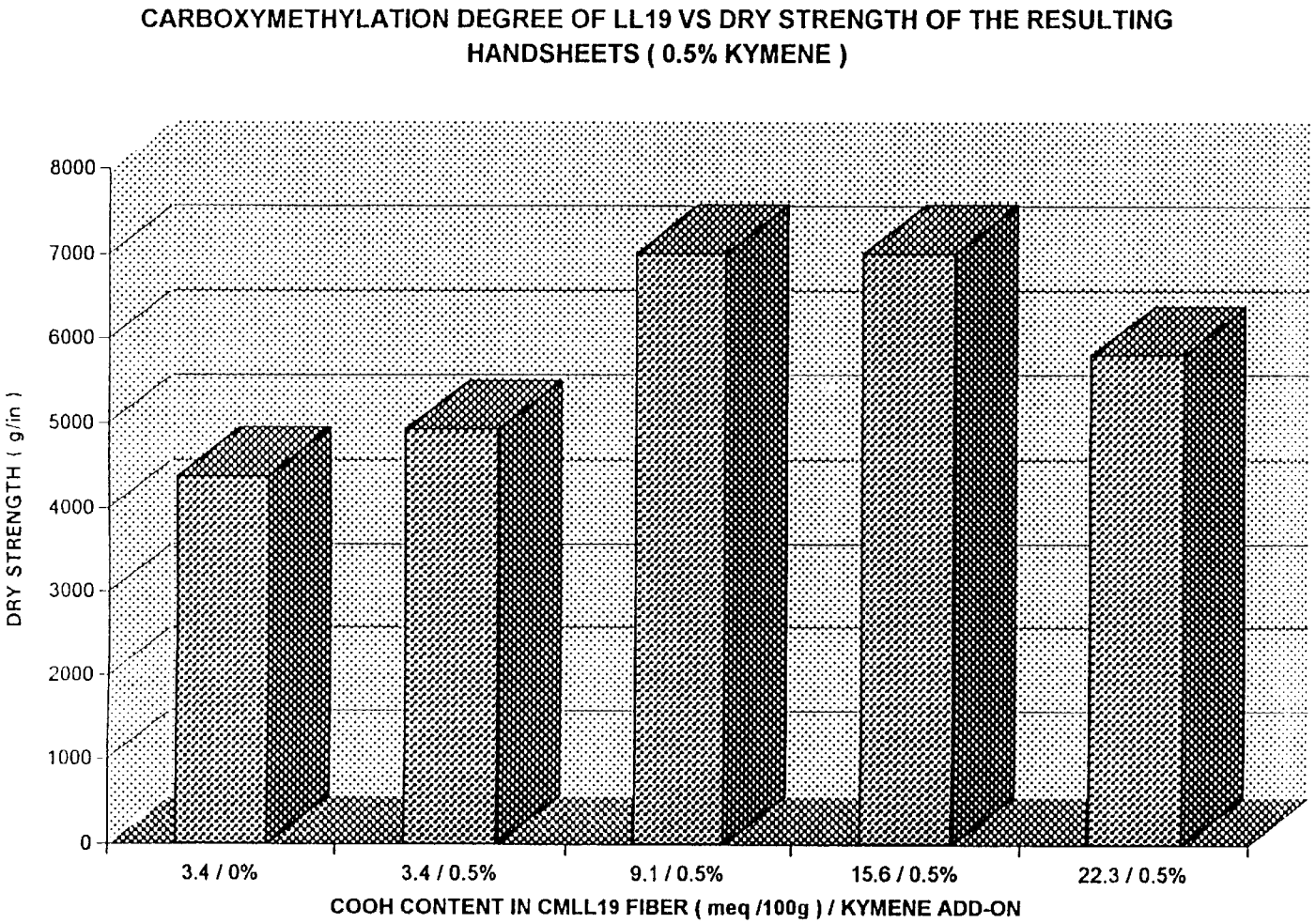
FIGS. 1 through 4 show that the wet TEA, (tensile energy absorption), wet strength, dry TEA and dry strength of a sheet material are all improved by the compositions processes of the invention.
Figure 2:
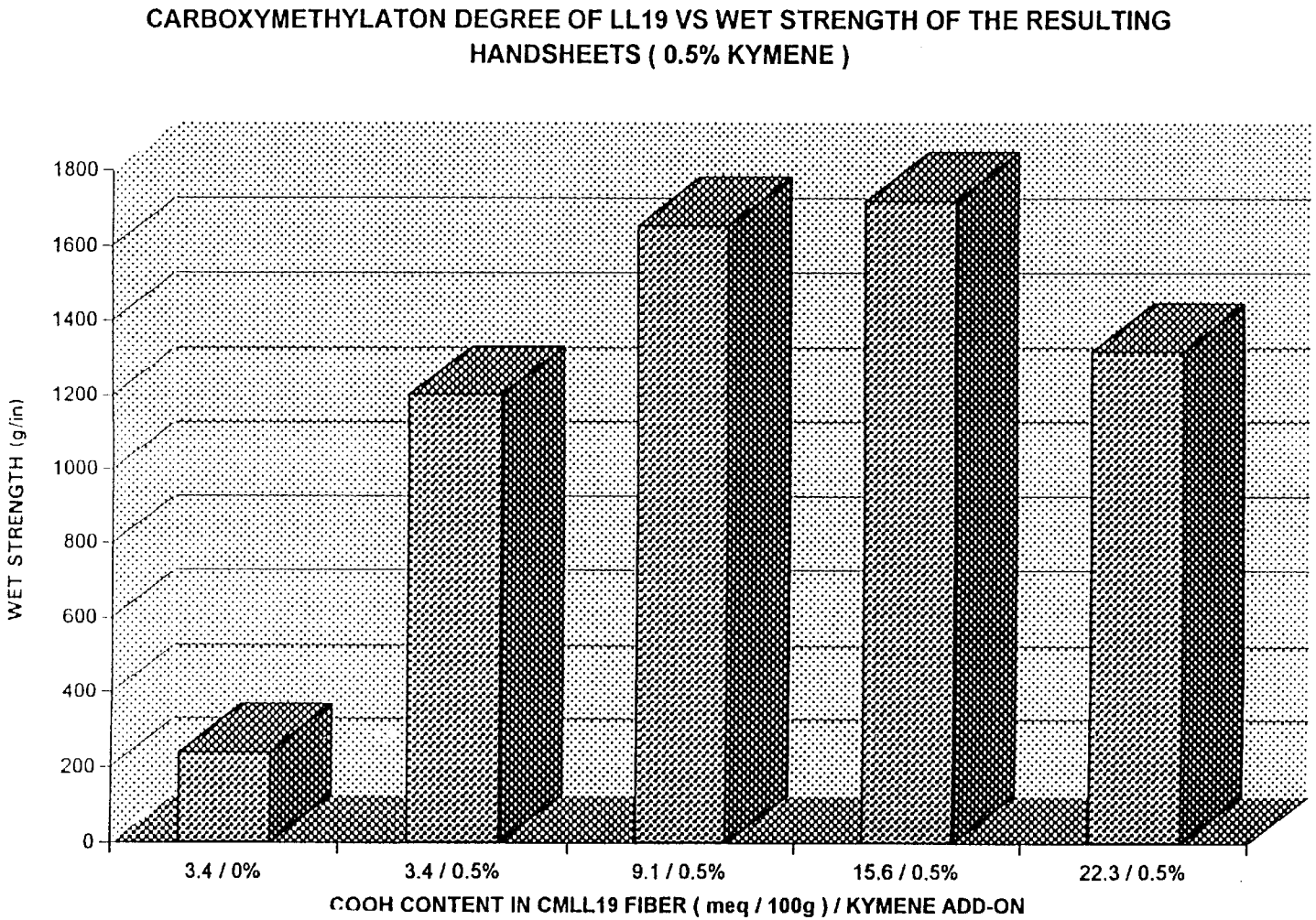
Figure 3:
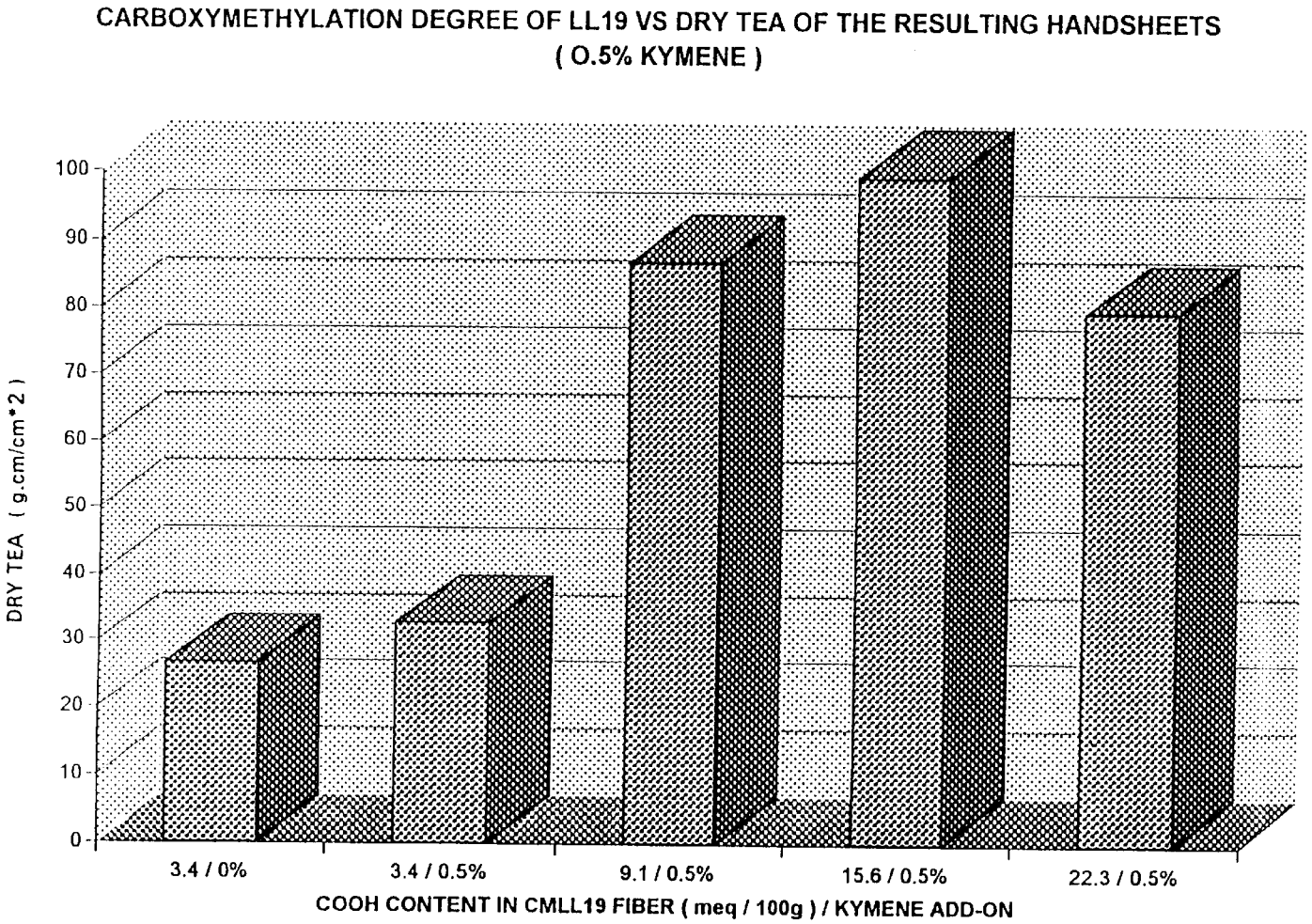
Figure 4:
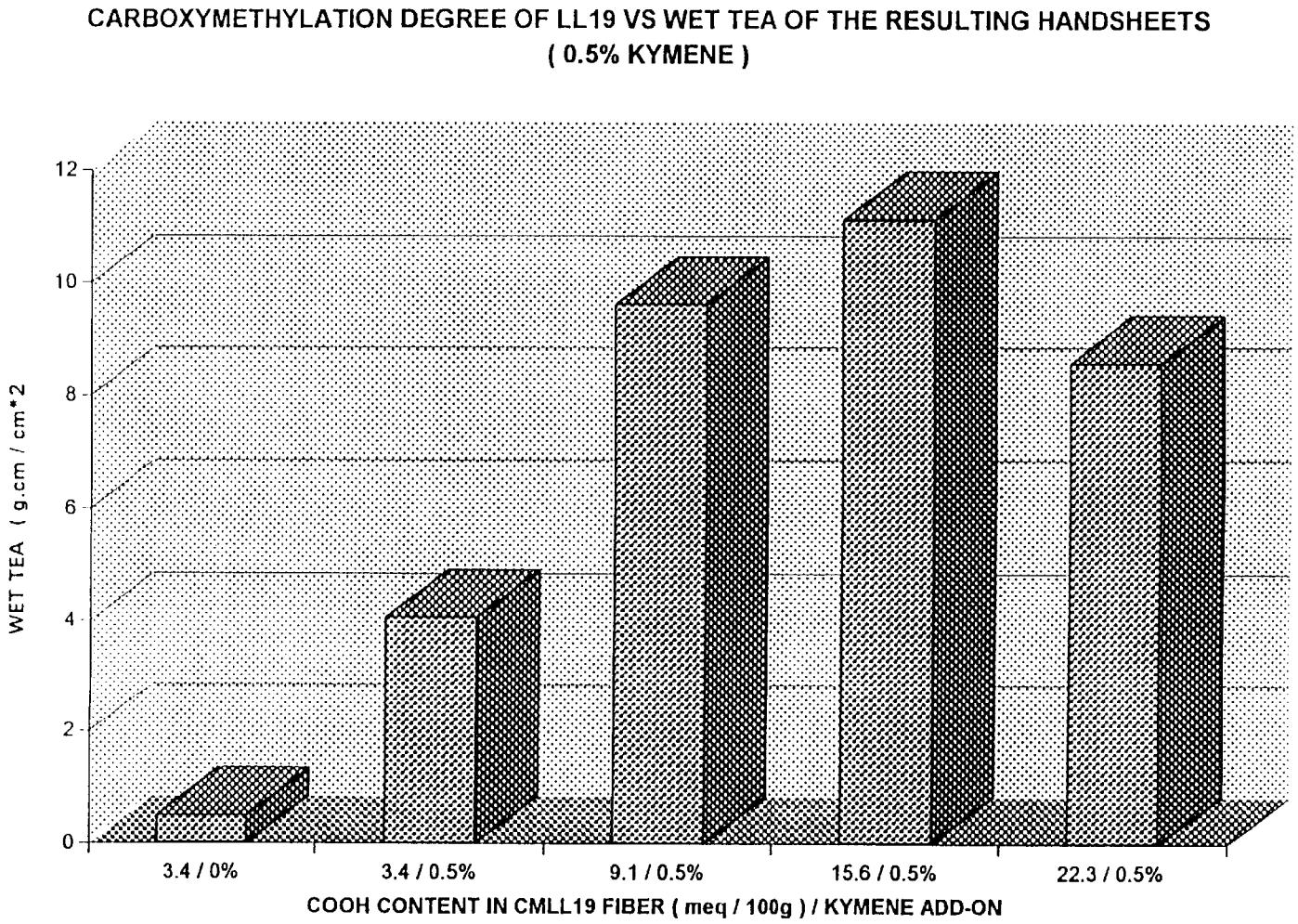

A conventionally pressed tissue paper and similar wet laid cellulosic sheets and methods for making such sheets are used in the compositions of the invention. Such paper sheets are typically made by depositing a paper making furnish on a foraminous forming wire. The forming wire is often referred to in the art as a fourdrinier wire. Once the furnish is deposited on the forming wire, it is referred to as a web. The web is dewatered by pressing the web and drying the web at elevated temperatures. The particular techniques and typical equipment for making such webs are, according to the process just described, are well known to those skilled in the art. In a typical process, a low consistency pulp furnish is provided in a pressurized head box. The head box has an opening for delivering a thin deposit of a pulp furnish onto the fourdrinier wire to form a wet web. The web is typically then dewatered to a fiber consistency of between about 7% and about 25% (total web basis weight) by vacuum dewatering and further dried by pressing operations wherein the web is subjected to pressure developed by opposing mechanical members, for example, cylindrical rolls or felts. The dewatered web is then further pressed and dried in a stream drum apparatus known in the art as a Yankee drier. Pressure can be developed at the Yankee drier by mechanical means such as opposing cylindrical drum pressing against the web. Multiple Yankee drier drums can be employed, whereby additional pressing is optionally incurred between the drums. The sheet structures which are formed are referred to as conventional pressed sheet or paper structures. Such sheets are considered to be compacted since the web is subjected to substantial and mechanical compression forces while the fibers are moist and are then dried while compressed.

The products and the products of the inventive processes of the invention are typically made from a pulp that is pre-reacted with a carboxymethyl forming reagent prior to sheet forming processes.

Carboxymethyl cellulose physically prepared in an alkali metal form using sodium or potassium cations is anionic (due to the introduction of carboxyl groups onto the fiber), hydrophilic sometimes water soluble cellulosic ether. A very wide range of substitution of carboxy groups onto the cellulose can be achieved. The most widely used types range from about 0.1 to about 1.5 DS where water solubility is achieved as the DS approaches 0.6. Useful insoluble fibers typically have a DS less than 0.6. Low molecular weight also tends to increase solubility. The common method for manufacturing carboxymethyl cellulose is the reaction of sodium chloroacetate with an alkali-cellulose complex. Such complexes are typically represented as $R_{cell}OH$:NaOH. The chloro moiety of the sodium chloroacetate typically reacts with a hydroxyl group on the alkali cellulose complex to form an ether group substituting the carboxymethyl group for the hydroxyl group originally in a cellulosic substrate. Carboxymethyl cellulose is a typically widely used cellulosic ether material and has a wide variety of applications. Most commonly, the hydroxymethyl cellulose is used as a solution or dispersion of the material in aqueous solutions. Applications include foods, pharmaceuticals, cosmetics, additive coatings, sizing, etc. for paper products, as adhesives, in ceramics, detergents and textiles. Similar processes can be used to form carboxyalkyl celluloses, however, these reagents are less reactive and of limited value.

Thus, suitable cationic materials for the practice of this invention may be selected from the group consisting of common cationic fabric softening agents, such as certain fiber-substantive quaternary ammonium compounds; common wet-strength additives, such as the urea-formaldehyde and melamine-formaldehyde resins; aminopolyamide reaction products with epichlorohydrin, such as the commercially available resin, Kymene, from Hercules, Inc., and cationic materials obtained by the reaction of polyalkylene polyamines with polysaccharides, such as starch, Irish moss extract, gum, tragacanth, dextrin, Veegum, carboxymethyl cellulose, locust bean gum, Shiraz gum, Zanzibar gum, Karaya gum, agar agar, guar gum, psyllium seed extract, gum arabic, gum acacia, Senegal gum, algin, British gum, flaxseed extract, ghatti, Iceland moss extract and quince seed extract. These and other suitable fiber-substantive additives are disclosed in the following U.S. Patents, which are incorporated herein by reference: U.S. Pat. No. 3,409,500 (Nov. 5, 1968) and U.S. Pat. No. 3,448,005 (June 3, 1969); U.S. Pat. No. 2,926,116 (Feb. 23, 1960); U.S. Pat. No. 3,520,774 (Jul. 14, 1970); U.S. Pat. No. 3,469,569 (Mar. 14, 1972); and U.S. Pat. No. 3,686,025 (Aug. 11, 1972). Among the most preferred cationic materials are Parez-630 NC, a modified polyacrylamide obtained from American Cyanamid, Kymene, urea-formaldehyde and melamine-formaldehyde resins, and quaternary ammonium compounds such as quaternary bis-octadecyl dimethyl ammonium chloride. The present invention can contain about 0.01% to about 2.0%, more preferably from about 0.03% to about 0.5% by weight, on a dry fiber weight basis, of a quaternary ammonium compounds having the formula:

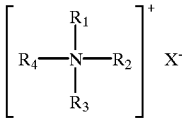

In the structure noted above each $R_1$, $R_2$, $R_3$ and $R_4$ is an aliphatic hydrocarbon radical selected from the group consisting of alkyl having from about 1 to about 18 carbon atoms, coconut and tallow. $X^-$ is a compatible anion, such as an halide (e.g., chloride or bromide) or methylsulfate. Preferably, $X^-$ is methylsulfate. As used above, "coconut" refers to the alkyl and alkylene moieties derived from coconut oil. It is recognized that coconut oil is a naturally occurring mixture having, as do all naturally occurring materials, a range of compositions. Coconut oil contains primarily fatty acids (from which the alkyl and alkylene moieties of the quaternary ammonium salts are derived) having from 12 to 16 carbon atoms, although fatty acids having fewer and more carbon atoms are also present. Swern, Ed in Bailey's Industrial Oil and Fat Products, Third Edition, John Wiley and Sons (New York 1964) in Table 6.5, suggests that coconut oil typically has from about 65 to 82% by weight of its fatty acids in the 12 to 16 carbon atoms range with about 8% of the total fatty acid content being present as unsaturated molecules. The principle unsaturated fatty acid in coconut oil is oleic acid. Synthetic as well as naturally occurring "coconut" mixtures fall within the scope of this invention.

Tallow, as is coconut, is a naturally occurring material having a variable composition. Table 6.13 in the above-identified reference edited by Swern indicates that typically 78% or more of the fatty acids of tallow contain 16 or 18 carbon atoms. Typically, half of the fatty acids present in tallow are unsaturated, primarily in the form of oleic acid. Synthetic as well as natural "tallows" fall within the scope of the present invention. Preferably, each $R_1$ is $C_{16}$–$C_{18}$ alkyl, most preferably each $R_1$ is straight-chain $C_{18}$ alkyl. Examples of quaternary ammonium compounds suitable for use in the present invention include the well known dialkyldimethylammonium salts such as ditallowdimethylammonium chloride, ditallowdimethylammonium methylsulfate; di(hydrogenated tallow)dimethylammonium chloride; with di(hydrogenated tallow)dimethylammonium methylsulfate being preferred. This particular material is available commercially from Sherex Chemical Company Inc. of Dublin, Ohio under the tradename "Varisoft200 ".

OPTIONAL INGREDIENTS

Other chemicals commonly used in papermaking can be added to the papermaking furnish so long as they do not significantly and adversely affect the softening, absorbency, and wet strength enhancing actions of the three required chemicals. For example, surfactants may be used to treat the tissue paper webs of the present invention. The level of surfactant, if used, is preferably from about 0.01% to about 2.0% by weight, based on the dry fiber weight of the tissue paper. The surfactants preferably have alkyl chains with eight or more carbon atoms. Exemplary anionic surfactants are linear alkyl sulfonates, and alkylbenzene sulfonates. Exemplary nonionic surfactants are alkylglycosides including alkylglycoside esters such as Crodestata™ SL-40 which is available from Croda, Inc. (New York, N.Y.); alkylglycoside ethers as described in U.S. Pat. 4,011,389, issued to W. K. Langdon, et al. on Mar. 8, 1977; and alkylpolyethoxylated esters such as Pegosperse™ 200 ML available from Glyco Chemicals, Inc. (Greenwich, Conn.) and IGEPAL RC-520 available from Rhome Poulenc Corporation (Cranbury, N.J.). Other types of chemicals which may be added include dry strength additives to increase the tensile strength of the tissue webs. Examples of dry strength additives include carboxymethyl cellulose, and cationic polymers from the ACCO chemical family such as ACCO 771 and ACCO 514, with carboxymethyl cellulose being preferred. This material is available commercially from the Hercules Company of Wilmington, Del. under the tradename HERCULES® CMC. The level of dry strength additive, if used, is preferably from about 0.01% to about 1.0%, by weight, based on the dry fiber weight of the tissue paper.

The novel sheet products of the invention are prepared by a process of mixing in water sufficient cellulosic pulp to form a typical furnish. Sufficient sodium chloroacetate is added to the furnish to produce a carboxymethyl cellulose having a ds of about 0.01 to about 6. High molecular weight fibers are preferred to result in a substantially insoluble modified cellulose. While some soluble materials will inherently be formed, the majority of the cellulosic input to the process is typically modified but remains insoluble. Prior to reaction between the fiber and the sodium chloroacetate, a sodium hydroxide modified cellulose is prepared by mixing the cellulose with an appropriate amount of sodium hydroxide in a mixer capable of intimately contacting the sodium hydroxide with the reduced fiber material. Once the sodium hydroxide is fully incorporated into the caustic modified fiber, the mixture is heated to a temperature greater than ambient, but typically not greater than about 100° C. and the heated material is reacted with a sodium chloroacetate solution added in sufficient quantity to result in a ds from about 0.01 to about 6. The cellulose is reacted with the chloroacetate solution for a period of time sufficient to produce the fiber modification typically less than 16 hours. The surface modified fibers are then washed with water and diluted acetic acid until the pH of the resulting affluent is about 6 to about 7.5. The carboxyl content of the fiber can then be determined to ensure that the fiber remains in soluble sheet forming material. Modified fibers can then be mixed with a cationic additive or mixtures of cationic additives depending on the goal of the preparation. The cationic additives can be a wet strength resin, a debonding agent, a softening agent, a dewatering agent, a sizing agent, or any other additive than can provide a property or attribute to the sheet formed subsequently. Such materials can beneficially be used as a tissue or towel or wipe. We have found that fiber modified as described when compared to untreated fiber, the dry strength, wet strength, dry tea and wet tea of hand sheets are significantly improved using the ionically associated additive carboxymethyl cellulose materials. Add-in, add-on level of about 0.5 to about 5 wt %, improvement in dry strength, wet strength and wet tea has been observed for hand sheets made from the carboxymethyl aided cellulosic fiber with a carboxyl content of about 1 to about 20 milliequivalents per 100 grams of fiber, commonly the carboxyl content ranges from about 5 to about 15 milliequivalents per 100 grams of fiber. The add-on of the cationic material is typically used at approximately a stoichiometric amount of cationic charge in the cationic additive to the anionic charge of the carboxyl group in the modified cellulosic material. Less than that amount of cationic material produces less than optimal results while substantially greater amounts provide no improvement.

The preferred products made in the sheet forming method of the application relate to tissue and towel manufacture. Tissues and towels can have a single layer or multiple layers of material. In multiple layers, the layers can comprise the sheet formed product of the invention or conventional sheets in combination with modified sheets made according with the process of the invention. Such tissues can be a flat, embossed, creped or otherwise modified to enhance the surface physical profile of the paper product.

EXAMPLE 1

A source of wood pulp was contacted with service water for a sufficient period of time to saturate the pulp with water to soften the pulp. After equilibration, excess water was expressed from the pulp. The pulp ranged from about 20 to 50 wt % of pulp on an aqueous pulp product. The wet fiber was mixed with an appropriate amount of sodium hydroxide in a sigma ribbon mixer for 20 to 60 minutes at room temperature to form a sodium hydroxide modified pulp material. A calculated amount of sodium chloroacetate solution to produce a substitution of about 0.01 to about 6 was added to the caustic modified pulp. The resulting mixture was blended until uniform and heated to a temperature of between 40 to 100° F. for between 5 and 16 hours depending on the concentration of sodium chloroacetate. After reaction was complete, the surface modified carboxymethylated wood fiber was washed with water and then with diluted acetic acid to render the pH to be approximately neutral, a pH of 6 to 7.5. The carboxyl content of the fiber was determined and the fiber was found to be in a substantially insoluble carboxymethyl cellulosic material. The carboxymethyl cellulose modified fibers were then mixed with at least one cationic additive or a mixture of cationic additives and then introduced into a common sheet forming tissue or towel making method.

I claim:

1. A process for forming a wet laid sheet comprising:

a) chemically attaching anionic groups via etherification to the surface of the cellulosic web fiber resulting in an anionic modified sheet-forming fiber; and b) adding one or more cationic additives, prior to wet-forming, to the anionic fiber to form an ionic association between the cationic additive and the anionic fiber; and c) forming a wet laid sheet;

wherein ionic interactions between the anionic and cationic groups are enhanced.

2. The process of claim 1 wherein the anionic groups comprise carboxymethyl groups.

3. The process of claim 2 wherein the carboxymethyl groups are added via an alkaline treatment comprising sodium chloroacetate.

4. The process of claim 1 wherein the cationic additive is selected from the group consisting of a wet-strength resin, a debonder, a softening agent, a dewatering aid and a sizing agent.

5. The process of claim 1 wherein the cationic additive is selected from the group consisting of a urea-formaldehyde resin and deacylated chitin.

6. A process for forming a wet laid sheet comprising the steps of:

a) subjecting wet cellulosic fibers to an alkaline treatment;

b) adding surface carboxymethyl groups to the cellulosic fibers;

c) washing the fibers to reach a pH of about 6 to 8;

d) mixing the washed fibers with one or more cationic additives; and e) forming a wet laid sheet.

7. The process of claim 6 wherein the alkaline treatment comprises mixing the fibers with an aqueous sodium hydroxide solution.

8. The process of claim 6 wherein the surface carboxymethyl groups are added via heating with sodium chloroacetate.

9. The process of claim 6 wherein the step of washing the fibers comprises washing the fibers with diluted aqueous acetic acid.

10. The process of claim 6 wherein the cationic additive is selected from the group consisting of a wet-strength resin, a debonder, a softening agent, a dewatering aid and a sizing agent.

11. The process of claim 6 wherein the cationic additive is selected from the group consisting of a urea-formaldehyde resin and deacylated chitin.

12. A process for chemically modifying cellulosic fibers comprising the steps of:

a) subjecting wet cellulosic fibers to an alkalinity treatment comprising aqueous sodium hydroxide;

b) adding surface carboxymethyl groups to the cellulosic fibers by treating with sodium chloroacetate;

c) washing the fibers with dilute aqueous acetic acid to reach a pH value of about 6 to 7.5; and d) mixing the washed fibers with one or more cationic additives.

13. The process of claim 12 wherein the cationic additive is selected from the group consisting of a wet-strength resin, a debonder, a softening agent, a dewatering aid and a sizing agent.

14. The process of claim 12 wherein the cationic additive is selected from the group consisting of a urea-formaldehyde resin and deacylated chitin.

* * * * *